United States Patent [19]

Waring

[11] 4,418,882

[45] Dec. 6, 1983

[54] VARIABLE HEIGHT ROD SUPPORTER

[76] Inventor: Helen W. Waring, Rt. #2, Box 303, Mt. Pleasant, S.C. 29464

[21] Appl. No.: 311,554

[22] Filed: Oct. 15, 1981

[51] Int. Cl.[3] ..... A47H 1/10

[52] U.S. Cl. ..... 248/265; 160/339; 248/269; 248/320

[58] Field of Search ..... 248/257, 265, 269, 320, 248/289.1, 290; 16/91, 94 D, 95 D, 96 D, 102, 106; 160/246, 249, 252, 257, 258, 338, 339; 24/132 R, 132 AA

[56] References Cited

U.S. PATENT DOCUMENTS

| | | | |
|---|---|---|---|
| 642,247 | 1/1900 | Morris et al. | 248/265 X |
| 1,008,685 | 11/1911 | Wildman | 248/289.1 X |
| 1,170,919 | 2/1916 | McCallum | 248/290 |
| 1,884,414 | 10/1932 | Vroom | 248/262 |
| 2,180,863 | 11/1939 | Clancy | 24/132 R X |
| 2,207,516 | 7/1940 | Ganke | 24/132 R X |
| 2,391,936 | 1/1946 | Wilson | 248/320 |
| 2,461,417 | 2/1949 | Fallone | 248/257 X |
| 2,565,280 | 8/1951 | Tapp | 248/265 X |
| 2,798,545 | 7/1957 | Busciolano | 160/339 X |
| 2,910,121 | 10/1959 | Stern et al. | 160/339 X |
| 3,000,604 | 9/1961 | Schulze-Robbecke . | |
| 3,037,555 | 6/1962 | Kochanowski | 16/102 |
| 4,299,008 | 11/1981 | Burns | 16/95 D |

FOREIGN PATENT DOCUMENTS

| | | | |
|---|---|---|---|
| 517521 | 2/1940 | United Kingdom | 248/320 |

*Primary Examiner*—J. Franklin Foss
*Assistant Examiner*—David L. Talbott
*Attorney, Agent, or Firm*—Larry Harold Kline

[57] ABSTRACT

An apparatus is disclosed for supporting a rod or rods at varying heights horizontally along a pre-designated area comprising a first roller track containing a first guide roller, a second roller track containing a second guide roller, and a rod attachment bar secured to a first support shaft to which the first guide roller is rotatably secured, and secured to a second support shaft to which the second guide roller is rotatably secured, with height adjustment apparatus to raise or lower the rod attachment bar to which the rod or rods may be secured.

9 Claims, 13 Drawing Figures

VARIABLE HEIGHT ROD SUPPORTER

This invention relates to an apparatus for hanging a rod or a plurality of rods and more particularly to an apparatus in which a rod attachment bar may be raised or lowered.

In hanging a rod or rods for use with curtains, drapes, or other decorative dressings, various holders may be utilized to secure the rod or rods. Normally, a person must reach high into the air or stand on some ladder or object in order to reach the area where the holder is secured into the structure. The present invention provides a rod attachment bar which may be raised or lowered allowing persons to secure the rod to the holder secured to the rod attachment bar, and to raise or lower the rod with the window or door dressing upon it, as desired. The present invention will enable various short persons, and persons with disabilities, old age, or fear of heights to function for themselves in hanging various decorative dressings.

An object of the present invention is to provide an apparatus for raising and lowering a rod attachment bar to which a rod may be secured.

Another object of the present invention is to provide cord locking means to lock a cord into position when the cord is utilized for raising or lowering a rod attachment bar.

A further object of the present invention is to provide an apparatus to which curtains, drapes, or other decorative dressings may be secured at a lower height, with the decorative dressings being raisable to a higher height.

Still another object of the present invention is to enable persons who are short, disabled, old, or have a fear of heights to function for themselves in hanging various decorative dressings.

Still another object of the present invention is to provide an apparatus for raising or lowering a rod attachment bar which can have an optional retractable center support for use with heavy or long decorative dressings.

A further object of the present invention is to provide an apparatus which can be secured around an opening in a structure which can be utilized to hang or remove various decorative dressings, as desired by the present or future user of the apparatus.

These and other objects and features of the invention will be apparent from the following description and appended claims.

Briefly, an apparatus is disclosed for supporting a rod or rods at varying heights horizontally along a pre-designated area of a structure. The apparatus comprises a first roller track secured onto one vertical side of the pre-designated area. A second roller track is secured onto the second vertical side of the pre-designated area. A first guide roller is guidable within the first roller track. A second guide roller is guidable within the second roller track. The first guide roller is rotatably secured around a first support shaft. The second guide roller is rotatably secured around a second support shaft. A rod attachment bar is rigidly secured to the first support shaft and the second support shaft. A rod or a plurality of rods may be secured to the rod attachment bar. Height adjustment means is secured within the apparatus. The height adjustment means is operative to raise or lower the rod attachment bar. When the rod attachment bar is moved, the first guide roller is guided within the first roller track and the second guide roller is guided within the second roller track. The rod attachment bar is thereby stabilized during movement.

The height adjustment means comprises a first hoisting pulley which is rotatably secured around the first support shaft. A second hoisting pulley is rotatably secured around the second support shaft. Hoisting means is connected around the first hoisting pulley and the second hoisting pulley and extends above the pre-designated area.

The hoisting means comprises cord means, cord securing means, a plurality of guide pulleys, and cord locking means. The cord means extends through the apparatus. The cord securing means is secured to the cord means near the outside top of the first roller track. The cord means extends through the plurality of guide pulleys. The cord locking means is secured to the second roller track and is operative to secure the cord means. The height of the rod attachment bar may be secured at any height by the cord locking means. The cord means extends from the cord securing means, through the plurality of guide pulleys, through the first hoisting pulley and the second hoisting pulley, and through the cord locking means to a location where persons, who are short, disabled, old, or have a fear of heights, can easily reach the cord means. The hoisting means is operative to raise or lower the rod attachment bar.

The plurality of guide pulleys comprises a first guide pulley secured near the inside top of the first roller track. A second guide pulley is secured near the inside top of the second roller track. A third guide pulley is secured near the outside top of the second roller track.

The first roller track comprises a first guide area defined by a first right guide member and a first right front guide member. The first guide area is also defined by a first left guide member and a first left front guide member.

The second roller track comprises a second guide area. The second guide area is defined by the second right guide member and a second right front guide member, as well as a second left guide member and a second left front guide member.

The apparatus further comprises a retractable center support which is secured above the pre-designated area of the structure. The retractable center support is operative to support the rod attachment bar. The retractable center support comprises a base securable to the structure, a pivot connection secured to the base, a support piece secured to the pivot connection, and a support area within the support piece where the rod attachment bay may be supported.

The apparatus further comprises a first cover, sized and shaped to fit over the first roller track. The first cover may be utilized to provide a decorative effect and to serve as a dust cover. The apparatus may have a second cover, sized and shaped to fit over the second roller track. The second cover may be utilized to provide a decorative effect and to serve as a dust cover.

The invention will be more fully understood from the following detailed description and appended claims when taken with the drawings in which:

FIG. 1 is an elevational view of apparatus 1 secured around window 8 with the rod attachment bar 2 of apparatus 1 near the bottom of window 8.

FIG. 2 is an elevational view of apparatus 1 secured around window 8 with a curtain 13 secured onto rod attachment bar 2 and being raised, with a partial cut-away view showing the curtain rod 12.

Figure 6:
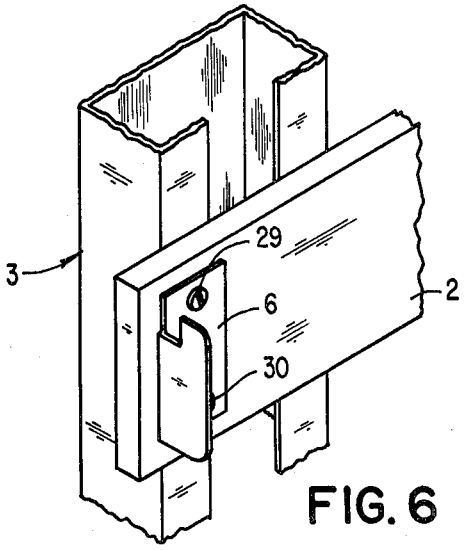

FIG. 6 is a partial isometric view of the rod attachment bar 2 and roller track 3 with a single rod securing clip 6 attached to rod attachment bar 2.

Figure 7:
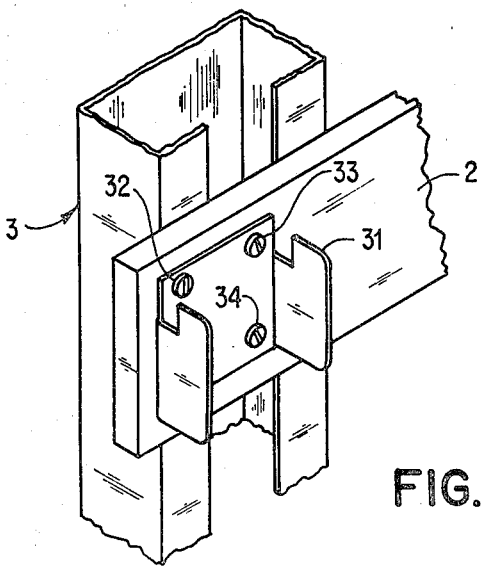

FIG. 7 is a partial isometric view of the rod attachment bar 2 and roller track 3 with a double rod securing clip 31 attached to rod attachment bar 2.

Figure 8:
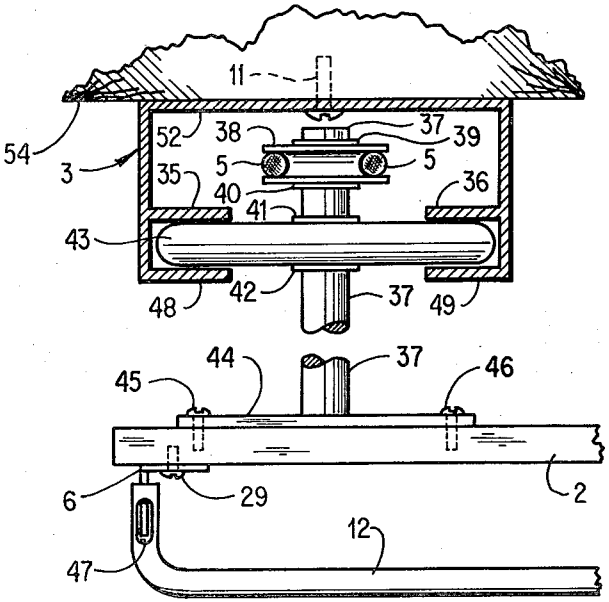

FIG. 8 is a partial top sectional view showing the roller track 3, with guide roller 43 therein, and the rod attachment bar 2 with appropriate connections thereto.

Figure 9:
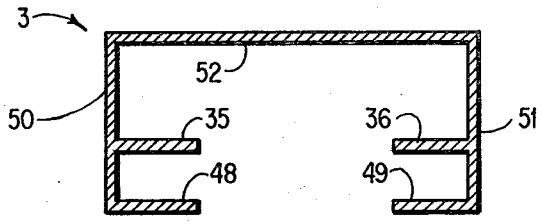

FIG. 9 is a top sectional view of roller track 3 alone.

Figure 10:
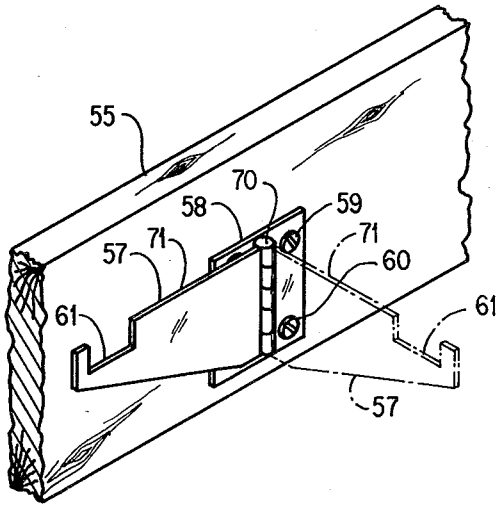

FIG. 10 is an isometric view of retractable center support 57.

Figure 11:
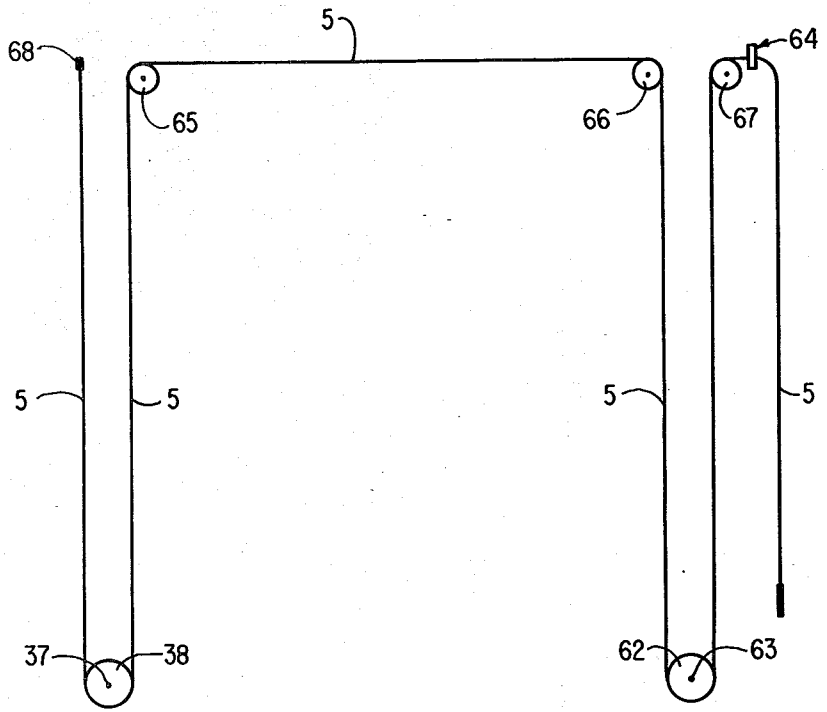

FIG. 11 is a schematic representation of the routing system for cord 5.

Figure 12:
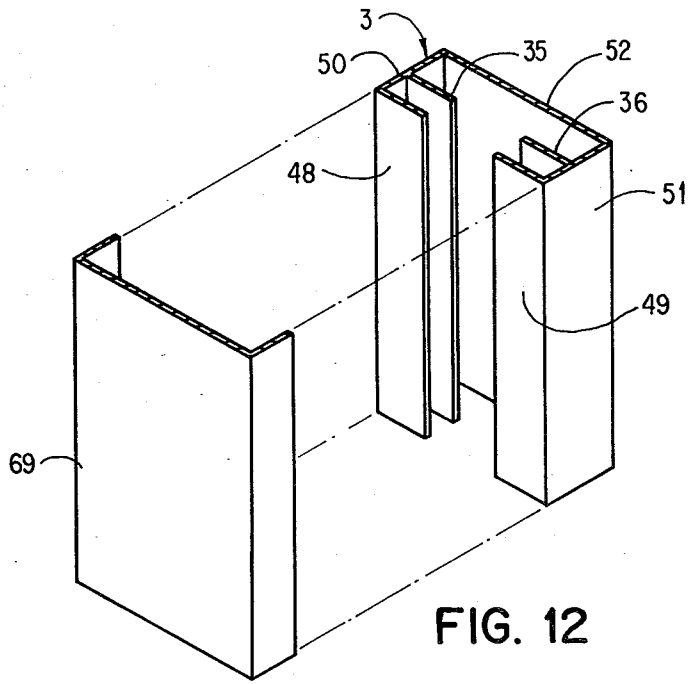

FIG. 12 is a partial isometric view showing roller track cover 69 exploded from roller track 3.

Figure 13:
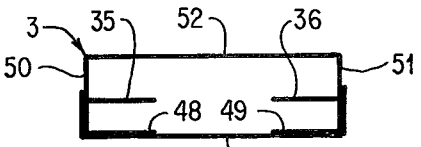

FIG. 13 is a top view showing roller track cover 69 attached onto roller track 3.

Figure 1:
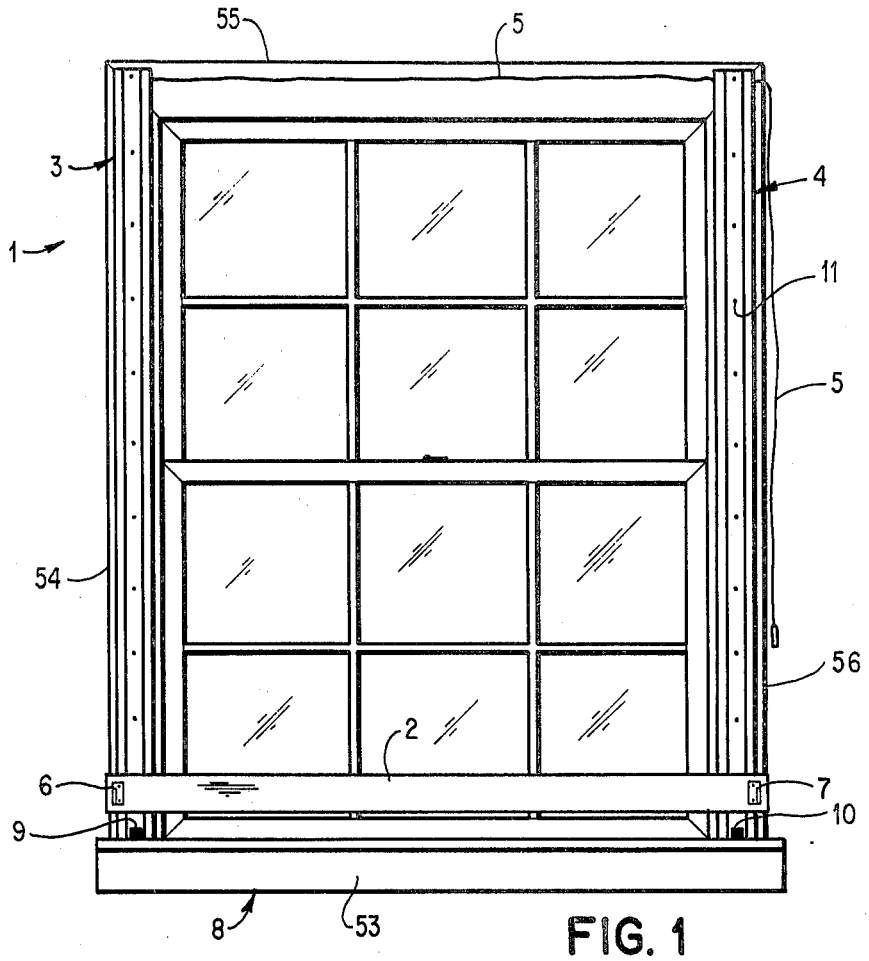

Referring now to the drawings, FIG. 1 is a elevational view of apparatus 1 secured around window 8 with the rod attachment bar 2 of apparatus 1 located near the bottom of window 8. Rod attachment bar 2 has secured to it single rod securing clips 6 and 7. Apparatus 1 comprises a roller track 3 and a roller track 4 on each vertical side of window 8. The rod attachment bar 2 is connected to the roller track 3 and roller track 4 and may be guided up and down roller tracks 3 and 4 by use of cord 5. The window 8 has a window sill 53, window jambs 54 and 56, and a window head 55. A rod may be secured to single rod securing clips 6 and 7 in order to raise draperies or curtains to the top of the window 8. Apparatus 1 has a bottom stop 9 which may be secured to roller track 3 and a bottom stop 10 which may be secured to roller track 4 in order to provide a resting place for the rod attachment bar 2 when it is lowered. Bottom stops 9 and 10 would also prevent the rod attachment bar 2 from making contact with the window sill 53.

Figure 2:
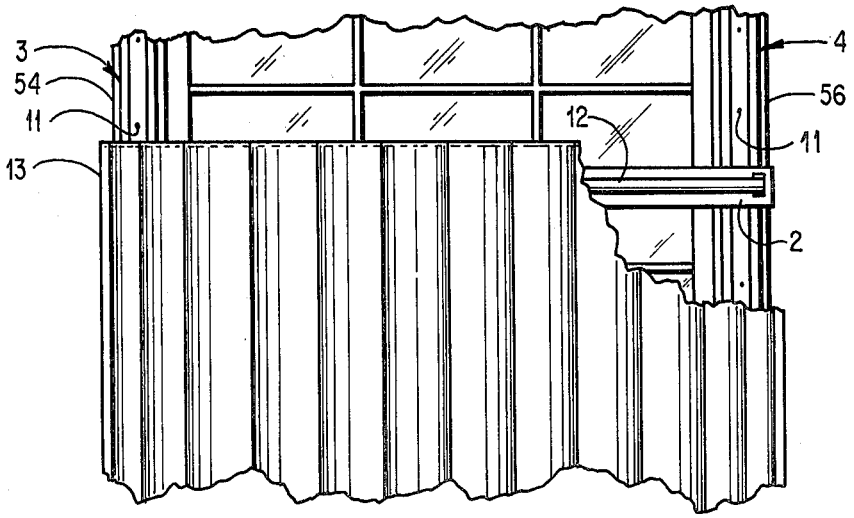

FIG. 2 is an elevational view of apparatus 1 secured around window 8 with a curtain 13 secured onto rod attachment bar 2 and being raised to a mid-level area of the window 8. A partial cut-away portion of FIG. 2 shows the curtain rod 12 secured onto the rod attachment bar 2. The roller tracks 3 and 4 are secured around the window 8 by securing means, such as a plurality of screws 11.

Figure 3:
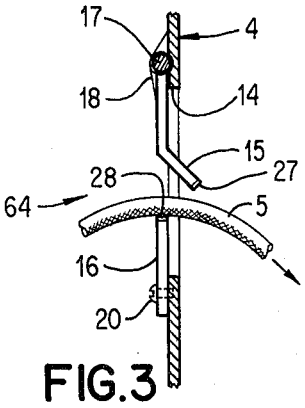
FIG. 3 is a detailed view of cord locking means 64 in the unlocked position.

FIG. 3 is a detailed view of cord locking means 64 in the unlocked position. The cord locking means 64 is located in the upper area of roller track 4.

Figure 4:
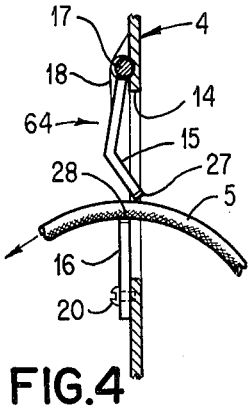
FIG. 4 is a detailed view of cord locking means 64 in the locked position.

FIG. 4 is a detailed view of cord locking means 64 in the locked position.

Figure 5:
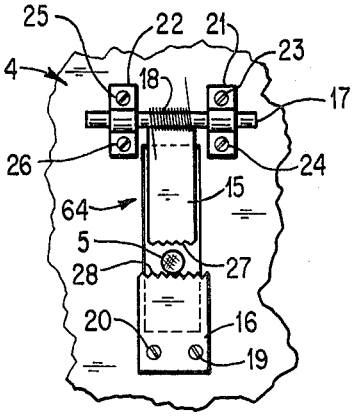
FIG. 5 is a rear elevational view of cord locking means 64.

FIG. 5 is a rear elevational view of cord locking means 64. Cord locking means 64 comprises a movable upper locking member 15 and a stationery lower locking member 16. The movable upper locking member 15 has a pivoting shaft 17. The pivoting shaft 17 is held onto roller track 4 by pivoting shaft securing means 21 and 22. Screws 23 and 24 hold securing means 21 to roller track 4. Screws 25 and 26 hold securing means 22 to roller track 4.

In operation, the cord locking means 64 enables the cord 5 to be pulled as far as desired and then to be secured or locked, when desired. The cord 5, when secured, is secured between the teeth 27 on movable upper locking member 15 and the teeth 28 on the lower locking member 16. The cord 5 can extend through the opening 14 in roller track 4.

FIG. 6 is a partial isometric view of rod attachment bar 2 and roller track 3 with a single rod securing clip 6 attached to rod attachment bar 2. Single rod securing clip 6 is secured onto rod attachment bar 2 by attachment screws 29 and 30.

FIG. 7 is a partial isometric view of the rod attachment bar 2 and roller track 3 with a double rod securing clip 31 attached to rod attachment bar 2. Double rod securing clip 31 is secured by attachment screws 32, 33, 34, and a screw, not shown. Any type of securing clip may be secured onto rod attachment bar 2 that is desired. The single rod securing clip 6 may be used for a single curtain rod. The double rod securing clip 31 may be used for a double curtain rod arrangement. Any other type of securing clip that may be desired for any purpose may be utilized and is within the scope of the present invention.

FIG. 8 is a partial top sectional view showing the roller track 3, with guide roller 43 therein, and rod attachment bar 2 with appropriate connections thereto. The roller track 3 is secured to window jamb 54 by a plurality of screws 11. A support shaft 37 is secured to mounting plate 44. Mounting plate 44 is secured by securing means, such as attachment screws 45 and 46, to the rod attachment bar 2. Guide roller 43 rolls on support shaft 37. Guide roller 43 is secured onto support shaft 37 by guide roller securing clips 41 and 42.

Rod attachment bar hoisting pulley 38 is held onto support shaft 37 by securing clips 39 and 40. Cord 5 fits within hoisting pulley 38 in order to raise or lower the support shaft 37, which in effect raises or lowers the rod attachment bar 2 and the curtains or draperies thereon.

The guide roller 43 rolls within the roller track 3 within a rolling area with the opposite ends defined by various guide members. One side of roller track 3 has a guide area defined by roller track guide member 35 and roller track front guide member 48. The other side of roller track 3 has a guide area defined by roller track guide member 36 and roller track front guide member 49. Roller track 4 has guide members similar to roller track 3 for a guide roller similar to guide roller 43 to be guided therein.

Connected to the other side of rod attachment bar 2 in a similar manner is another support shaft, support shaft 63 (see FIG. 11), similar to support shaft 37, and all supporting members as shown in FIG. 8 for roller track 3. Therefore, roller track 4 would have within it a similar arrangement as shown in FIG. 8 for roller track 3, including a separate guide roller support shaft hoisting pulley 62 (see FIG. 11), hoisting pulley securing clips, and guide roller securing clips.

The rod attachment bar 2 is shown having secured to it a similar rod securing clip 6. A drapery or curtain rod 12 is secured to single rod securing clip 6 utilizing securing opening 47 on rod 12. Rod 12 would be secured to single rod securing clip 7 (as shown in FIG. 1) on the other end of rod attachment bar 2.

FIG. 9 is a top sectional view of roller track 3 showing roller track 3 alone. Roller track 3 has side members 50 and 51 and a rear member 52. Guide areas are defined on one side by roller track guide member 35 and roller track front guide member 48, and on the other side by roller track guide member 36 and roller track front guide member 49. Roller track 4 would be identical to roller track 3.

FIG. 10 is an isometric view of retractable center support 57. In FIG. 10, retractable center support 57 is shown in solid lines in the retracted position and in broken lines in the extended position. When in the extended position, the retractable center support 57 may support the center of rod attachmemt bar 2, which is secured onto support shaft 37, which moves within roller track 3, and a similar support shaft which moves within roller track 4.

The rod attachment bar 2 may be raised by use of the cord 5 above the retractable center support 57, and the retractable center support 57 then may be extended. The rod attachment bar 2 would then be lowered slightly so that the rod attachment bar 2 would rest within the notch 61 of retractable center support 57. The cord 5 would be locked in position by cord locking means 64.

If the rod, such as rod 12, which is secured onto the rod attachment bar 2, requires further support in the center, a fixed center support can be secured directly onto the rod attachment bar 2 when the rod attachment bar 2 is in the lowered position.

Retractable center support 57 comprises a base 58, which is secured into the window head 55 by mounting screws, such as screws 59 and 60 and other screws, not shown. The support piece 71 of retractable center support 57 is secured to the base 58 by pivot connection 70. Notch 61 in support piece 71 provides a place for the rod attachment bar 2 to rest in and be supported in.

FIG. 11 is a schematic representation of the routing system for cord 5. Cord 5 may be utilized to raise or lower the rod attachment bar 2 which is secured to support shafts 37 and 63. The bar hoisting pulley 38 is attached to the support shaft 37. The bar hoisting pulley 62 is attached to the support shaft 63. The cord is permanently fixed to the cord securing means 68, which may be secured onto the roller track 3. Guide pulley 65 may be secured to roller track 3. Guide pulley 66 and guide pulley 67 may be secured to roller track 4. Cord locking means 64 may be secured to roller track 4. The Cord 5 is secured at cord securing means 68.

When the cord 5 is pulled, the cord 5 turns on pulleys 65, 66, and 67. Cord 5 pulls equally against hoisting pulleys 62 and 38 in order to raise or lower the support shafts 37 and 63. When the support shafts 37 and 63 are raised or lowered, the drapes or curtains secured to rod 12 are also raised or lowered because they are secured to the rod attachment bar 2, which is secured to the support shafts 37 and 63.

FIG. 12 is a partial isometric view showing roller track cover 69 exploded from roller track 3. Roller track cover 69 can be of a similar shape and size to the rollers tracks 3 or 4. The roller track cover 69 will prevent dust or other foreign substances from entering the internal region of roller tracks 3 or 4. The roller track cover 69 may be used for decorative purposes and may be made from any material in any color desired.

FIG. 13 is a top view showing the roller track cover 69 attached onto roller track 3. The roller track cover 69 may be designed to fit by friction, as shown, or may be secured in any desired manner.

The apparatus 1 enables a person, who may be short or may be uncomfortable on a ladder or in a raised position, to place drapery or curtains onto an apparatus. The apparatus can be raised or lowered, as desired by the user. A cord 5 runs through the apparatus to control the height that the rod attachment bar 2 is located. Various types of cord locking means can be utilized to secure the cord 5, when desired. Various types of pulleys or pulley connections can be utilized to guide the cord 5 through the apparatus 1. Various types of securing clips can be secured to the rod attachment bar 2 to secure whatever hanging material is desired to cover a window or opening. The apparatus can be used around any opening including a window, a door, or to simply cover any area in which a material covering is desired.

If hanging material long or heavy, a retractable center support 57 may be utilized to support the rod attachment bar 2. The retractable center support 57 does not have to be used with the apparatus 1, but is optional.

The various support pieces may be mounted in any desired manner. The guide rollers within roller tracks 3 and 4 may be mounted in any desired manner. The pulleys may be mounted within the roller tracks 3 and 4 in any desired manner. The roller tracks may be made from any desired material and secured around the framework of an opening in any desired manner. The apparatus can be any size or shape desired by the user or manufacturer. The apparatus may be secured by any securing means around the opening. The opening may be a window, door, or any other desired area in a structure in which a decorative dressing is desired. The apparatus may be secured in a permanent manner so that present or future users of the apparatus will easily be able to hang or remove various decorative dressings.

A cover for the roller tracks may be utilized to provide further decorative effect and to serve as a dust cover. These covers may be interchangable, paintable, re-usable, or replaceable, as desired.

The invention provides an apparatus for raising or lowering a rod attachment bar to which a rod or a plurality of rods may be secured. Curtains, drapes, or other decorative dressings may be secured to the rod or the plurality of rods and may be secured at a lower height, with the decorative dressings being raisable to a higher height. This enables persons who are short, disabled, old, or have a fear of heights to function for themselves in hanging various decorative dressings. The rod attachment bar may have an optional retractable center support for use with heavy or long decorative dressings. Cord locking means is provided to lock a cord into position when the cord is utilized for raising or lowering a rod attachment bar. This apparatus can be secured around an opening in a structure and can be utilized to hang or remove various decorative dressings, as desired by the present or future user of the apparatus.

The apparatus may be secured onto the structure itself or to a portion of the opening, such as the frame around a window or door. In utilizing the apparatus, the drapery, curtains, or other decorative dressings may be placed onto the rod or rods which are secured to the rod attachment bar at any height which is convenient to the user. The rod attachment bar does not have to be lowered to the lowest position, but can be secured at any variable height desired.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

I claim:

1. An apparatus for supporting a rod at varying heights horizontally along a pre-designated area of a structure comprising:

a. a first structure comprising a first roller track and a first pulley track secured onto one vertical side of said pre-designated area;

b. a second structure comprising a second roller track and a second pulley track secured onto the second vertical side of said pre-designed area;

c. a first guide roller guidable within said first roller track;

d. a second guide roller guidable within said second roller track;

e. a first support shaft around which said first guide roller is rotatably secured, with first guide roller securing means secured around said first support shaft on both sides of said first guide roller;

f. a second support shaft around which said second guide roller is rotatably secured, with second guide roller securing means secured around said second support shaft on both sides of said second guide roller;

g. a rod attachment bar rigidly secured to said first support shaft and said second support shaft to which a rod or a plurality of rods may be secured; and h. height adjustment means secured within said apparatus operative to raise or lower said rod attachment bar, whereby when said rod attachment bar is moved, said first guide roller is guided within said first roller track and said second guide roller is guided within said second roller track stabilizing said rod attachment bar during movement, said height adjustment means comprising:

(1) a first hoisting pulley rotatably secured around said first support shaft in said first pulley track, with first hoisting pulley securing means around said first support shaft on both sides of said first hoisting pulley;

(2) a second hoisting pulley rotatably secured around said second support shaft in said second pulley track, with second hoisting pulley securing means around said second support shaft on both sides of said second hoisting pulley; and (3) hoisting means connected around said first hoisting pulley, and therefore around said first support shaft, and said second hoisting pulley, and therefore around said second support shaft, and extending above said pre-designated area, operative to raise or lower said rod attachment bar.

2. An apparatus according to claim 1 wherein said hoisting means comprises:

a. cord means extending through said apparatus;

b. cord securing means securing said cord means near the outside top of said first roller track;

c. a plurality of guide pulleys through which said cord means extends;

d. cord locking means secured to said second roller track and operative to secure said cord means, thereby securing the height of said rod attachment bar, when desired, wherein said cord means extends from said cord securing means, through said plurality of guide pulleys, through said first hoisting pulley and through said second hoisting pulley, and through said cord locking means to a location where persons who are short, disabled, old, or have a fear of heights can easily reach said cord means.

3. An apparatus according to claim 2 wherein said plurality of guide pulleys comprises:

a. a first guide pulley secured near the inside top of said first roller track;

b. a second guide pulley secured near the inside top of said second roller track; and c. a third guide pulley secured near the outside top of said second roller track.

4. An apparatus according to claim 2 wherein said first roller track comprises a first guide area defined by a first right guide member and a first right front guide member, and a first left guide member and a first left guide member, through which said first guide roller is guided.

5. An apparatus according to claim 4 wherein said second roller track comprises a second guide area defined by a second right guide member and a second right front guide member, and a second left guide member and a second left front guide member, through which said second guide roller is guided.

6. An apparatus according to claim 1 further comprising a retractable center support secured above said pre-designated area of said structure operative to support said rod attachment bar.

7. An apparatus according to claim 6 wherein said retractable center support comprises:

a. a base securable to said structure;

b. a pivot connection secured to said base;

c. a support piece secured to said pivot connection; and d. a support area within said support piece wherein said rod attachment bar may be supported.

8. An apparatus according to claim 1 further comprising a first cover, sized and shaped to fit over said first roller track, whereby said first cover may be utilized to provide a decorative effect and to serve as a dust cover.

9. An apparatus according to claim 8 further comprising a second cover, sized and shaped to fit over said second roller track, whereby said second cover may be utilized to provide a decorative effect and to serve as a dust cover.

* * * * *